US006380689B1

(12) United States Patent
Okuda

(10) Patent No.: US 6,380,689 B1
(45) Date of Patent: Apr. 30, 2002

(54) DRIVING APPARATUS FOR ACTIVE MATRIX TYPE LUMINESCENT PANEL

(75) Inventor: Yoshiyuki Okuda, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/679,814

(22) Filed: Oct. 5, 2000

(30) Foreign Application Priority Data

Oct. 6, 1999 (JP) ..... 11-285203

(51) Int. Cl.[7] ..... G09G 3/10

(52) U.S. Cl. ..... 315/169.3; 315/169.1; 315/169.2; 345/60; 345/76; 345/77

(58) Field of Search ..... 315/169.1, 169.2, 315/169.3; 345/76, 60

(56) References Cited

U.S. PATENT DOCUMENTS 5,424,612 A * 6/1995 Kim ..... 315/169.3
5,670,974 A * 9/1997 Ohba et al. ..... 315/169.4
6,100,637 A * 8/2000 Kishino et al. ..... 315/169.3

FOREIGN PATENT DOCUMENTS

JP 7-111341 4/1995 ..... H01L/33/00

* cited by examiner

*Primary Examiner*—Don Wong
*Assistant Examiner*—Jimmy T. Vu
(74) *Attorney, Agent, or Firm*—Morgan, Lewis & Bockius

(57) ABSTRACT

A driving apparatus for an active matrix type luminescent panel, in which a reverse bias voltage can be applied to each EL device in the luminescent panel effectively. An address period and an emission period are repeatedly set on each of a plurality of capacitive light emitting devices in accordance with synchronizing timing in input image data. In an address period, a driving device corresponding to at least a device to be light-emitted of the plurality of capacitive light emitting devices is designated in accordance with the input image data. The designated driving device is turned on in the emission period subsequent to the address period, so that an emission voltage in forward polarity is applied to the device to be light-emitted device through the corresponding driving device in the emission period. In the address period, a bias voltage having polarity reverse to the forward polarity is applied to at least the device to be light-emitted.

12 Claims, 15 Drawing Sheets

DRIVING APPARATUS FOR ACTIVE MATRIX TYPE LUMINESCENT PANEL

BACKGROUND OF THE INVENTION

1. Field of the Invention

The invention relates to a driving apparatus for an active matrix type luminescent panel which uses capacitive light emitting devices such as organic electroluminescence devices.

2. Description of the Related Background Art

In recent years, with the trend of increasing the size of display devices, thinner display devices have been required, and a variety of thin display devices have been brought into practical use. An electroluminescence display comprising a plurality of organic electroluminescence elements arranged in a matrix has drawn attention as one of the thin display devices.

An organic electroluminescence device (hereinafter, also simply referred to as EL device) can be electrically represented by an equivalent circuit as shown in FIG. 1. As seen from the diagram, the device is replaceable with the circuitry consisting of a capacitive element C and an element E having diode characteristics, coupled to the capacitive element in parallel. The EL device is therefore considered as a capacitive light emitting device. The EL device, when a direct-current emission drive voltage is applied across its electrodes, stores a charge into the capacitive element C. Subsequently, when a barrier voltage or emission threshold voltage specific to this device is exceeded, an electric current starts to flow from the electrode (on the anode side of the diode element E) to an organic functional layer which carries the light emitting layer, so as to emit light in an intensity proportional to this current.

Such known EL-device luminescent panels include simple matrix type luminescent panels and active matrix type luminescent panels. A simple matrix type luminescent panel has EL devices simply arranged in a matrix. An active matrix type luminescent panel has matrix-arranged EL devices each of which is added with a driving device consisting of transistors. A driving apparatus for an active matrix type luminescent panel repeatedly alternates an address period and an emission period to drive each EL device for light emission. In an address period, to-be-operated EL devices on the matrix luminescent panel are designated. In an emission period, an emission voltage is applied to the EL devices designated in the address period.

It is empirically known that the application of voltage to EL devices in a reverse direction not participating in light emission extends the life of the devices. Nevertheless, conventional driving apparatuses for an active matrix type luminescent panel, e.g. as described in Japanese Patent Laid-Open Publication No.Hei 7-111341, apply nothing but a forward voltage to EL devices in an emission period. No reverse bias voltage is applied to the EL devices in either period.

SUMMARY OF THE INVENTION

In view of the foregoing, it is an object of the present invention to provide a driving apparatus for an active matrix type luminescent panel, the driving apparatus being capable of applying a reverse bias voltage to each EL device in the active matrix type luminescent panel effectively.

A driving apparatus for an active matrix type luminescent panel according to the present invention is a driving apparatus for an active matrix type luminescent panel including a plurality of capacitive light emitting devices arranged in a matrix, each having polarity, and driving devices for driving the plurality of capacitive light emitting devices individually, the driving apparatus comprising: setting means for setting an address period and an emission period repeatedly on each of the plurality of capacitive light emitting devices in accordance with synchronizing timing in input image data; ON holding means for designating a driving device of the driving devices corresponding to at least a device to be light-emitted of the plurality of capacitive light emitting devices in accordance with the input image data in the address period so that the designated driving device is turned on in the emission period subsequent to the address period; and voltage applying means for applying an emission voltage, in forward polarity, to the device to be light-emitted through the designated driving device in the emission period, wherein the voltage applying means applies a bias voltage, in polarity reverse to the forward polarity, to at least the device to be light-emitted, in the address period.

A driving apparatus for an active matrix type luminescent panel according to the present invention is a driving apparatus for an active matrix type luminescent panel including a plurality of capacitive light emitting devices arranged in a matrix, each having polarity, and driving devices for driving the plurality of capacitive light emitting devices individually, the driving apparatus comprising: setting means for setting an address period and an emission period repeatedly on each of the plurality of capacitive light emitting devices in accordance with synchronizing timing in input image data; designating means for accepting and holding a brightness voltage corresponding to a brightness level in the input image data immediately before the address period, and designating, in the address period, an active device corresponding to at least a device to be light-emitted of the plurality of capacitive light emitting devices in accordance with the brightness voltage; holding means for turning the designated active device on or active in accordance with the brightness voltage in the emission period subsequent to the address period; and voltage applying means for applying an emission voltage, in forward polarity, to the device to be light-emitted through the designated active device in the emission period, wherein the voltage applying means applies a bias voltage, in polarity reverse to the forward polarity, to at least the device to be light-emitted of the plurality of capacitive light emitting devices in the address period.

DETAILED DESCRIPTION OF THE PREFERRED EMBODIMENTS

Hereinafter, preferred embodiments of the present invention will be described in detail with reference to the accompanying drawings.

Figure 1:
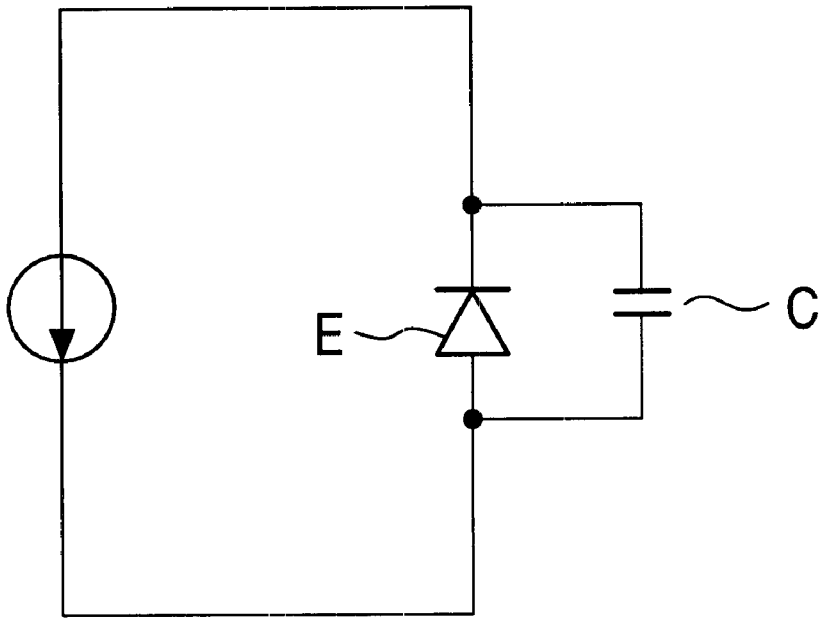
FIG. 1 is a circuit diagram showing an equivalent circuit representing an EL device.
Figure 2:
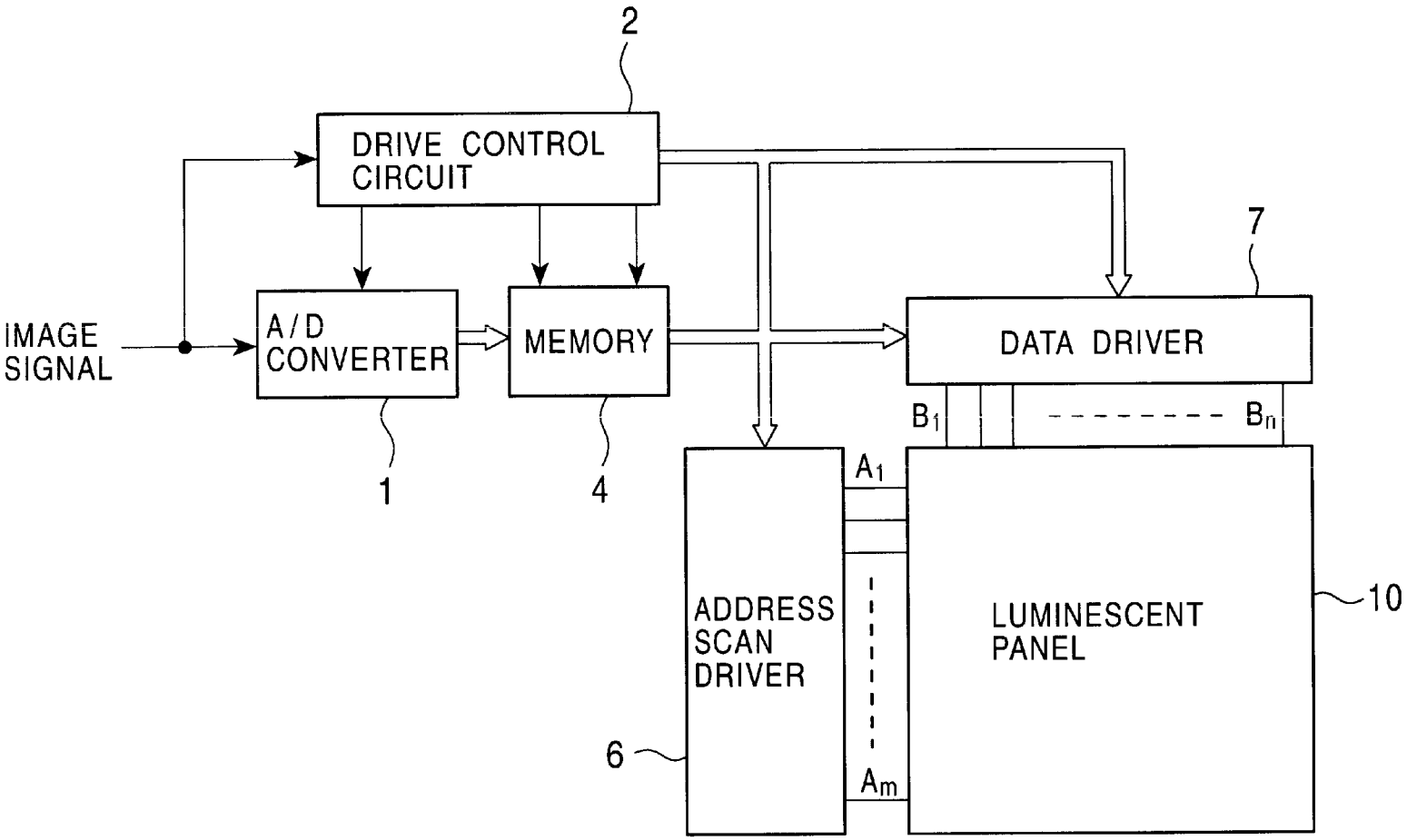
FIG. 2 is a block diagram showing a driving apparatus of a line-sequential display system according to the present invention.

FIG. 2 shows a driving apparatus of a line-sequential display system using EL devices according to the present invention. The driving apparatus comprises an active matrix type luminescent panel 10, an A/D converter 1, a drive control circuit 2, a memory 4, an address scan driver 6, and a data driver 7.

The luminescent panel 10 has a plurality of EL devices $E_{1,1}$–$E_{m,n}$ arranged in a matrix at a plurality of intersections of address lines (anode lines) $A_1$–$A_m$ and data lines (cathode lines) $B_1$–$B_n$.

The address scan driver 6 is connected to the address lines $A_1$–$A_m$ of the luminescent panel 10. The address scan driver 6 supplies the individual address lines $A_1$–$A_m$ with one potential of an emission potential Ve exceeding an emission threshold Vth, a reverse bias potential −Va, and 0 V. The data driver 7 is connected to the data lines $B_1$–$B_n$ of the luminescent panel 10, and supplies the individual data lines $B_1$–$B_n$ with either a positive potential $V_L$ or 0 V.

The A/D converter 1 samples an analog image signal input thereto in accordance with a clock signal supplied from the drive control circuit 2. The signal sampled is converted into N-bit pixel data D corresponding to respective pixels, and supplied to the memory 4.

The memory 4 sequentially stores the above-mentioned pixel data D in accordance with a write signal supplied from the drive control circuit 2. When the storage operations for one screen (m rows, n columns) of the luminescent panel 10 are finished, the memory 4 divides pixel data $D_{11}$ to $D_{mm}$ of one screen for each bit digit in accordance with a read signal supplied from the drive control circuit 2. The resultants are read by row from the first row to the m-th row, and successively supplied to the data driver 7 as drive pixel data bit groups $DB_1$ to $DB_n$.

The drive control circuit 2 generates the clock signal for the A/D converter 1 and the write and read signals for the memory 4 in accordance with a horizontal synchronizing signal and a vertical synchronizing signal contained in the input image signal mentioned above.

Moreover, the drive control circuit 2 divides a single field period in the above-mentioned input image signal into eight subfields. In each subfield, the drive control circuit 2 supplies both the address scan drive 6 and the data driver 7 with a timing signal for applying various drive pulses to the luminescent panel 10. The field-to-subfield division is made for the sake of 256-gradation display. The respective subfields are set at 1, 2, 4, 8, 16, 32, 64, and 128 in relative brightness ratio so that selective combinations of these subfields realize 256 levels. Here, a single field period may be divided into any number of subfields other than eight.

Figure 3:
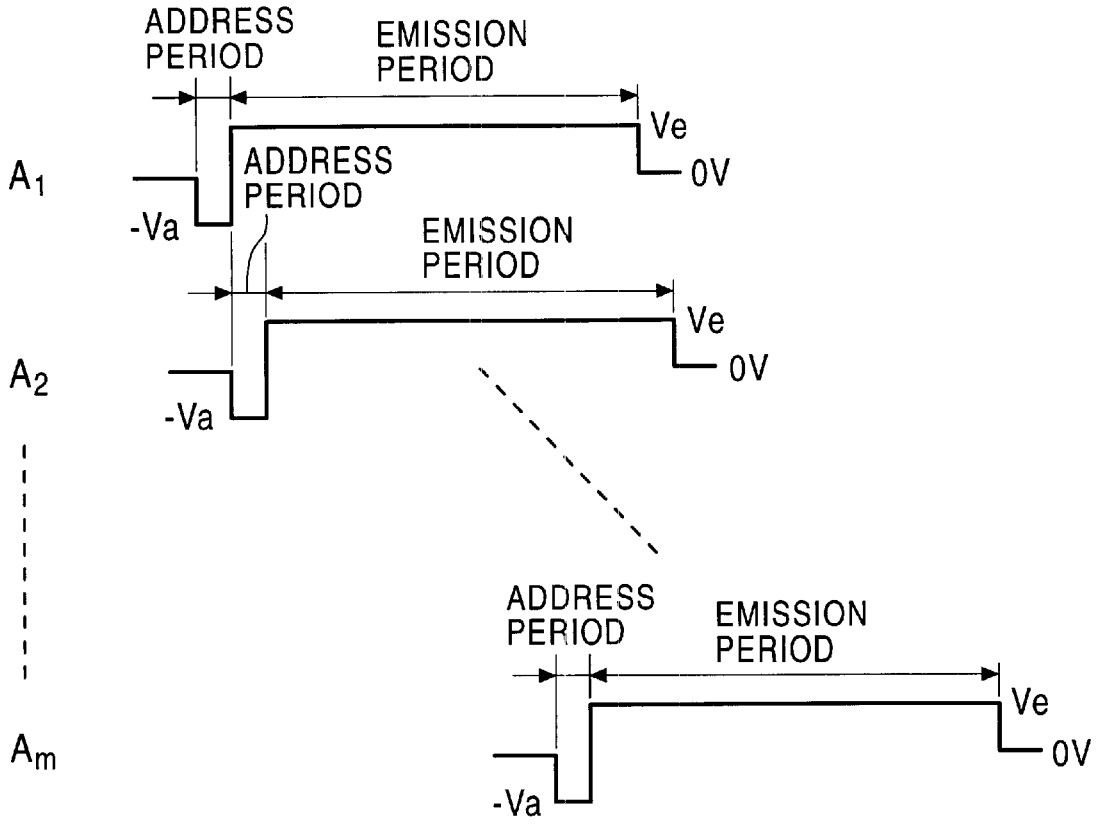
FIG. 3 is a diagram showing address periods and emission periods within a single subfield in the apparatus of FIG. 2.

Since the individual subfields involve common operations, description will be given on a single subfield alone. As shown in FIG. 3, address periods in a subfield correspond to the respective address lines $A_1$–$A_m$ and are in turn allocated from the address line $A_1$ to the address line $A_m$. From the beginning of the address period for the address line $A_1$, the respective beginnings of the address periods for address lines $A_2$–$A_m$ are in turn delayed by a predetermined period toward the address line $A_m$. In an address period, the address scan driver 6 supplies the address line with the reverse bias potential −Va as a scan pulse SP. The end of an address period is followed by an emission period, in which the address scan driver 6 supplies the emission potential Ve to the address line. For the individual address lines in one subfiels, the address periods have the same length and the emission periods also have the same length. In one field, however, as subfields position behind, emission periods are shorter.

The data driver 7 generates pixel data pulse groups $DP_1$–$DP_n$ corresponding to the drive pixel data bit groups $DB_1$–$DB_n$ read in succession from the memory 4, respectively. The pixel data pulse groups $DP_1$–$DP_n$ generated are successively supplied to the data lines $B_1$–$B_n$ under their address periods. For example, the data driver 7 generates a pixel data pulse having a voltage of $V_L$ when a data bit in a drive pixel data bit group DB has a logic level of "0," generates a pixel data pulse of 0 V under a logic level of "1," and applies the pixel data pulse of 0 V to the data lines $B_1$–$B_n$. That is, the data driver 7 applies one row (n pulses) of the pixel data pulses to the data lines $B_1$–$B_n$ as a pixel data pulse group DP mentioned above.

In an emission period, a current flows through only those EL devices on the intersections of the "row" to which the scan pulse SP is applied and the "columns" to which pixel data pulses of $V_L$ in voltage are applied, whereby the EL devices enter a luminescent state. EL devices subjected to the scan pulse SP while subjected to 0-V pixel data pulses are not applied with any current in the emission period, entering a non-luminescent state.

Figure 4:
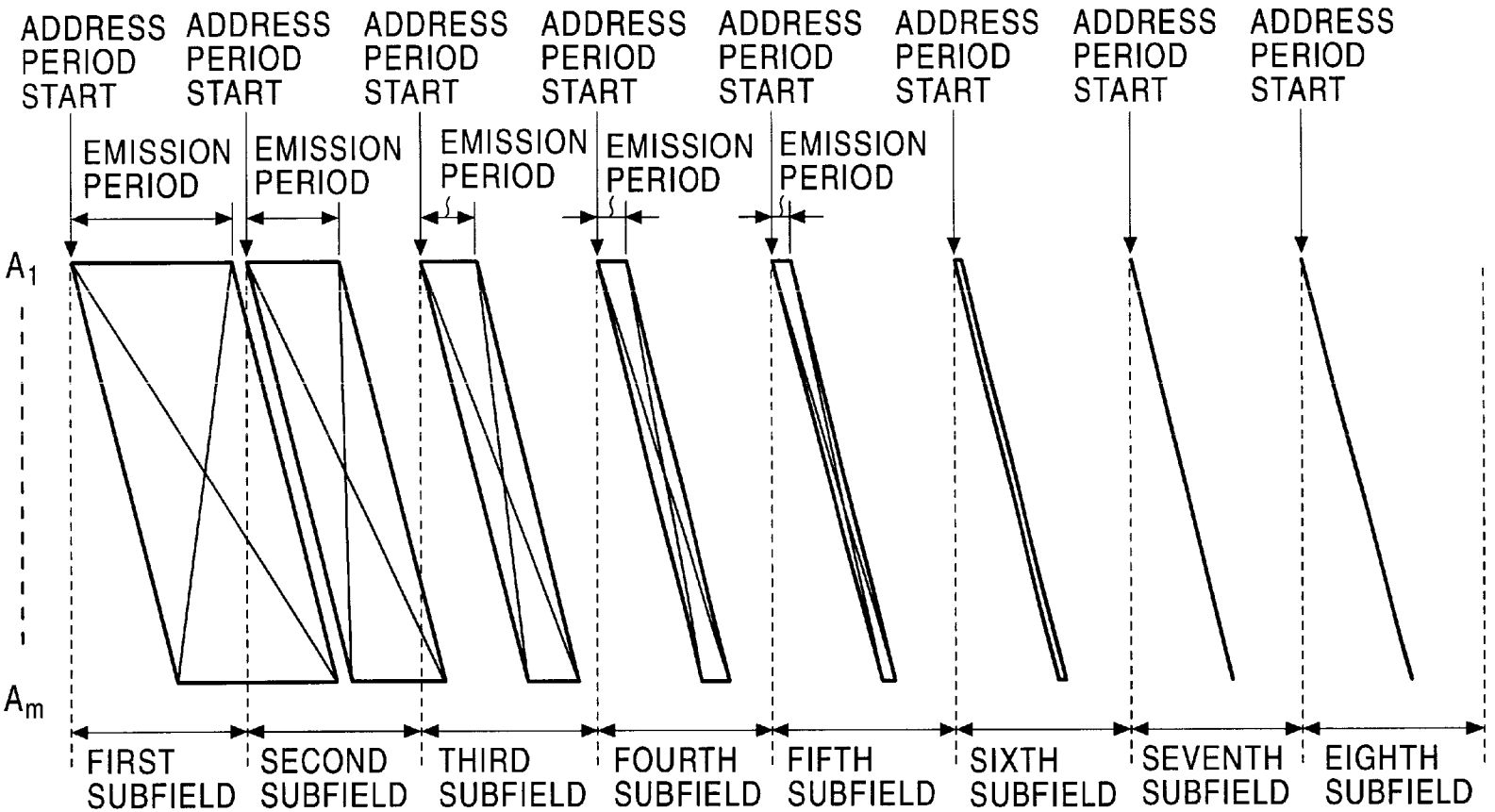
FIG. 4 is a diagram showing the subfield divisions in a single field under the line-sequential display system.

FIG. 4 shows the respective temporal positions of the first through eighth subfields in a field, with regard to the row direction of the luminescent panel 10 (the direction of the address lines $A_1$ to $A_m$). Immediately before the termination of each subfield, the address scan driver 6 supplies 0 V to the address lines $A_1$–$A_m$ to reset the EL devices.

Figure 5:
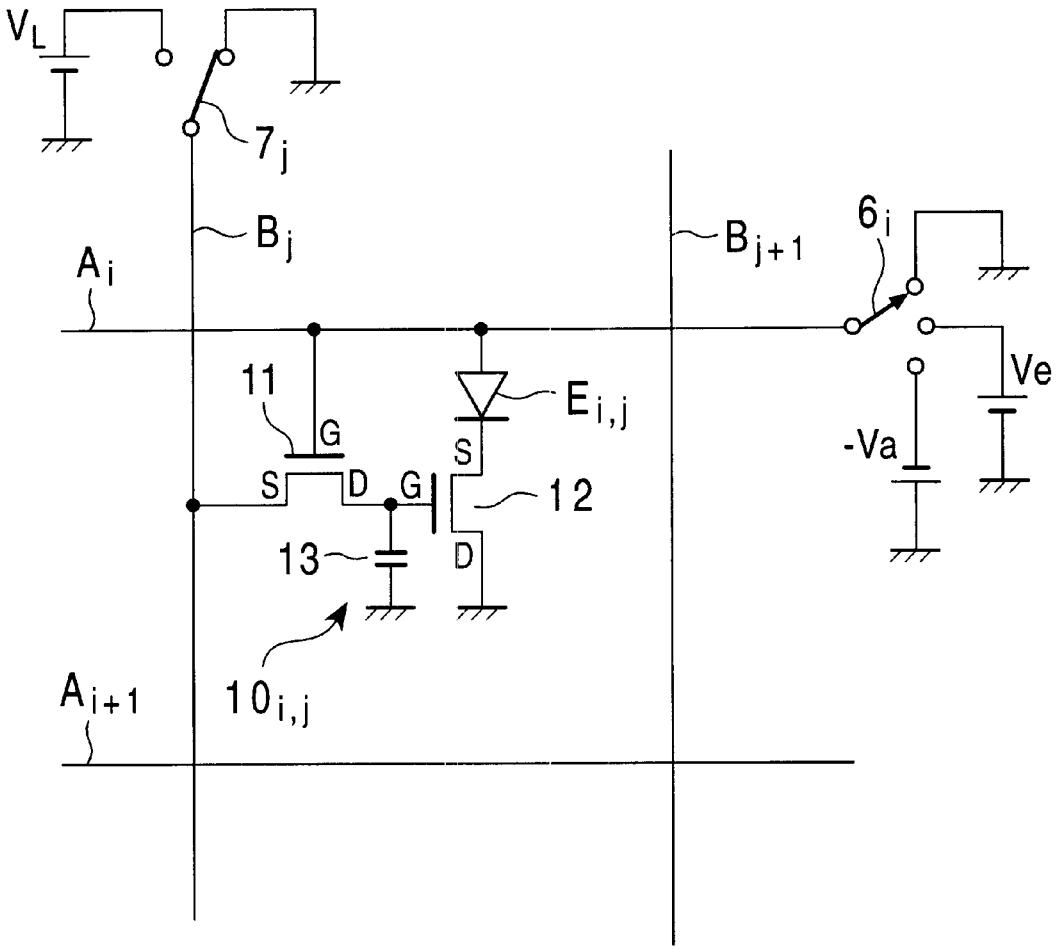
FIG. 5 is a circuit diagram showing an example of a light emitting circuit on the luminescent panel of FIG. 2.

FIG. 5 shows a light emitting circuit $\mathbf{10}_{i,j}$ including an EL device $E_{i,j}$. The EL device $E_{i,j}$ is arranged on the intersection between an address line $A_1$ of the address lines $A_1$–$A_m$ and a data line $B_j$ of the data lines $B_1$–$B_n$ in the luminescent panel 10. As well as the EL device $E_{i,j}$, the light emitting circuit $\mathbf{10}_{i,j}$ includes a P-ch (P-channel) MOSFET 11, an N-ch MOSFET 12, and a capacitor 13. The address line $A_i$ is connected to the anode of the EL device $E_{i,j}$ and the gate of the FET 11. The data line $B_j$ is connected to the source of the FET 11. The drain of the FET 11 is connected to the gate of the FET 12, and the connecting line therebetween is grounded through the capacitor 13. The cathode of the EL device $E_{i,j}$ is connected to the source of the FET 12. The drain of the FET 12 is grounded.

The address line $A_i$ is connected to a switch $6_i$ in the address scan driver 6. The switch $6_i$ selectively supplies the address line $A_i$ with any one potential of the above-mentioned emission potential Ve, reverse bias potential −Va, and 0-V ground potential. The data line $B_j$ is connected to a switch $7_j$ in the data driver 7. The switch $7_j$ supplies the data line $B_j$ with either the positive potential $V_L$ or the 0-V ground potential. The switches $6_i$ and $7_j$ are selected in accordance with the timing signals from the drive control circuit 2.

In a subfield for the EL device $E_{i,j}$ to emit light, the switch $6_i$ supplies the reverse bias potential −Va to the address line $A_i$ when the row of the address line $A_i$ enters an address period. That is, the selection of the address line $A_i$ is effected by supplying an addressing pulse having the negative potential of −Va. The negative potential −Va is applied to the anode of the EL device $E_{i,j}$. Since the cathode of the EL device $E_{i,j}$ is at the ground potential, the EL device $E_{i,j}$ is reverse-biased. During the address period, the data line $B_j$ is supplied with the positive potential $V_L$ through the switch $7_j$ so that the FET 11 is turned on to charge the capacitor 13 with the voltage $V_L$. Here, the terminal voltage of the capacitor 13, a positive voltage, is applied to the gate of the FET 12.

When the address period terminates to enter an emission period, the switch $6_i$ supplies the emission voltage Ve to the address line $A_i$, turning off the FET 11. The FET 12 is turned on because the charge voltage of the capacitor 13 is applied to its gate. Accordingly, the turning-on of the FET 12 equalizes the cathode of the EL device $E_{i,j}$ to the ground potential. Since the emission voltage Ve is applied to the EL device $E_{i,j}$ in the forward direction, a current flows to bring the EL device $E_{i,j}$ into the luminescent state.

When the emission period terminates, the switch $6_i$ supplies the 0-V ground potential to the address line $A_i$ so that the EL device $E_{i,j}$ becomes approximately 0 V across to enter a reset period.

The light emitting circuit $10_{i,j}$ performs the same operations in each of the first through eighth subfields. Moreover, each of the light emitting circuits $10_{1,1}$–$10_{m,n}$ in the luminescent panel 10 other than the light emitting circuit $10_{i,j}$ also performs the same operations as those of the light emitting circuit $10_{i,j}$.

Figure 6:
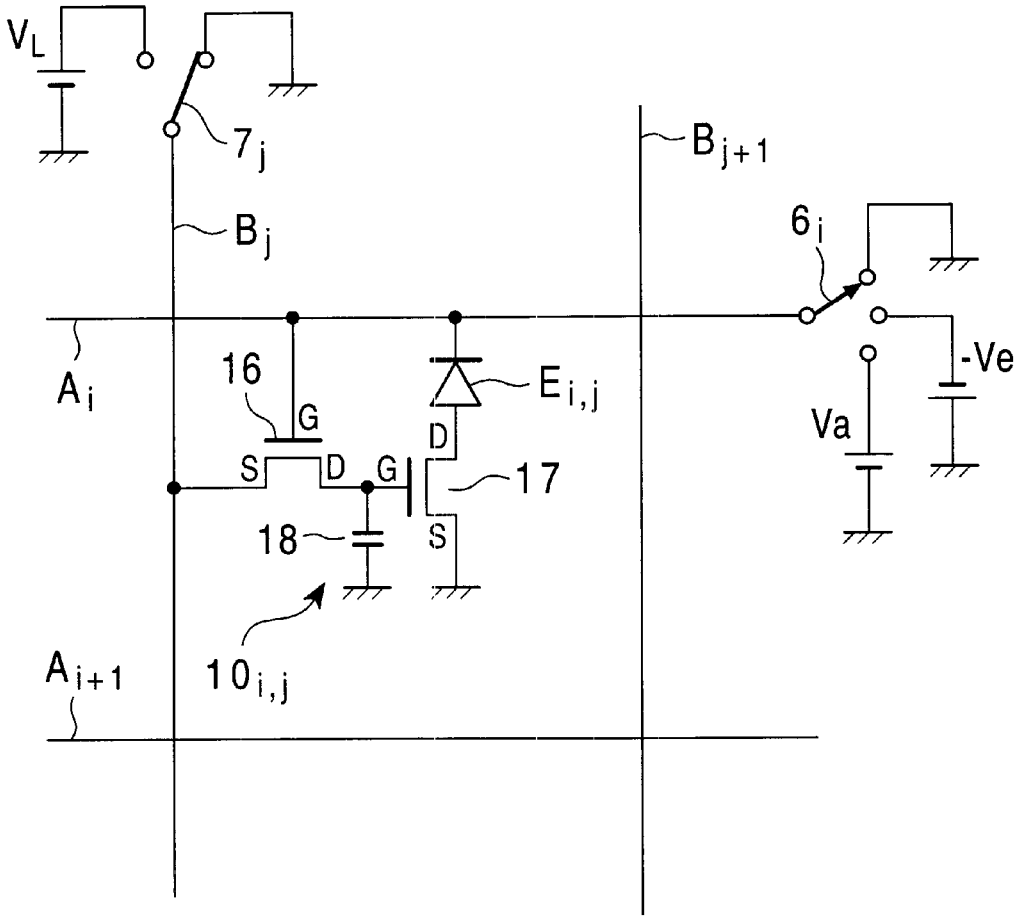
FIG. 6 is a circuit diagram showing another example of a light emitting circuit on the luminescent panel of FIG. 2.

The light emitting circuit $10_{i,j}$ may be configured as shown in FIG. 6. The light emitting circuit $10_{i,j}$ in FIG. 6 comprises an N-ch MOSFET 16, a P-ch MOSFET 17, and a capacitor 18, as well as the EL device $E_{i,j}$. The address line $A_i$ is connected to the cathode of the EL device $E_{i,j}$ and the gate of the FET 16. The data line $B_j$ is connected to the source of the FET 16. The drain of the FET 16 is connected to the gate of the FET 17, and the connecting line therebetween is grounded through the capacitor 18. The anode of the EL device $E_{i,j}$ is connected to the drain of the FET 17. The source of the FET 17 is grounded.

The switch $6_i$ connected to the address line $A_i$ selectively supplies the address line $A_i$ with any one potential of the above-mentioned emission potential −Ve, reverse bias potential Va, and 0 V. The switch $7_j$ connected to the data line $B_j$ supplies the data line $B_j$ with either the potential $V_L$ or 0 V. The switches $6_i$ and $7_j$ are turned in accordance with the timing signals from the drive control circuit 2.

In a subfield for the EL device $E_{i,j}$ of FIG. 6 to emit light, the switch $6_i$ supplies the reverse bias potential Va to the address line $A_i$ when the row of the address line $A_i$ enters an address period. Here, the positive potential Va is applied to the cathode of the EL device $E_{i,j}$. Since the anode of the EL device $E_{i,j}$ is at the ground potential, the EL device $E_{i,j}$ is reverse-biased as in the case of FIG. 5. During the address period, the data line $B_j$ is supplied with the positive potential $V_L$ through the switch $7_j$ so that the FET 16 is turned on to charge the capacitor 18 with the voltage $V_L$. Here, the terminal voltage of the capacitor 18, a positive voltage, is applied to the gate of the FET 17.

When the address period terminates to enter an emission period, the switch $6_i$ supplies the emission voltage −Ve to the address line $A_i$, turning off the FET 16. Meanwhile, the FET 17 is turned on because the charge voltage of the capacitor 18 is applied to its gate. Accordingly, the turning-on of the FET 17 equalizes the anode of the EL device $E_{i,j}$ to the ground potential. Since the emission voltage Ve is applied to the EL device $E_{i,j}$ in the forward direction, a current flows to bring the EL device $E_{i,j}$ into the luminescent state.

When the emission period terminates, the switch $6_i$ supplies the 0-V ground potential to the address line $A_i$ so that the EL device $E_{i,j}$ becomes approximately 0 V across to enter a reset period.

Figure 7:
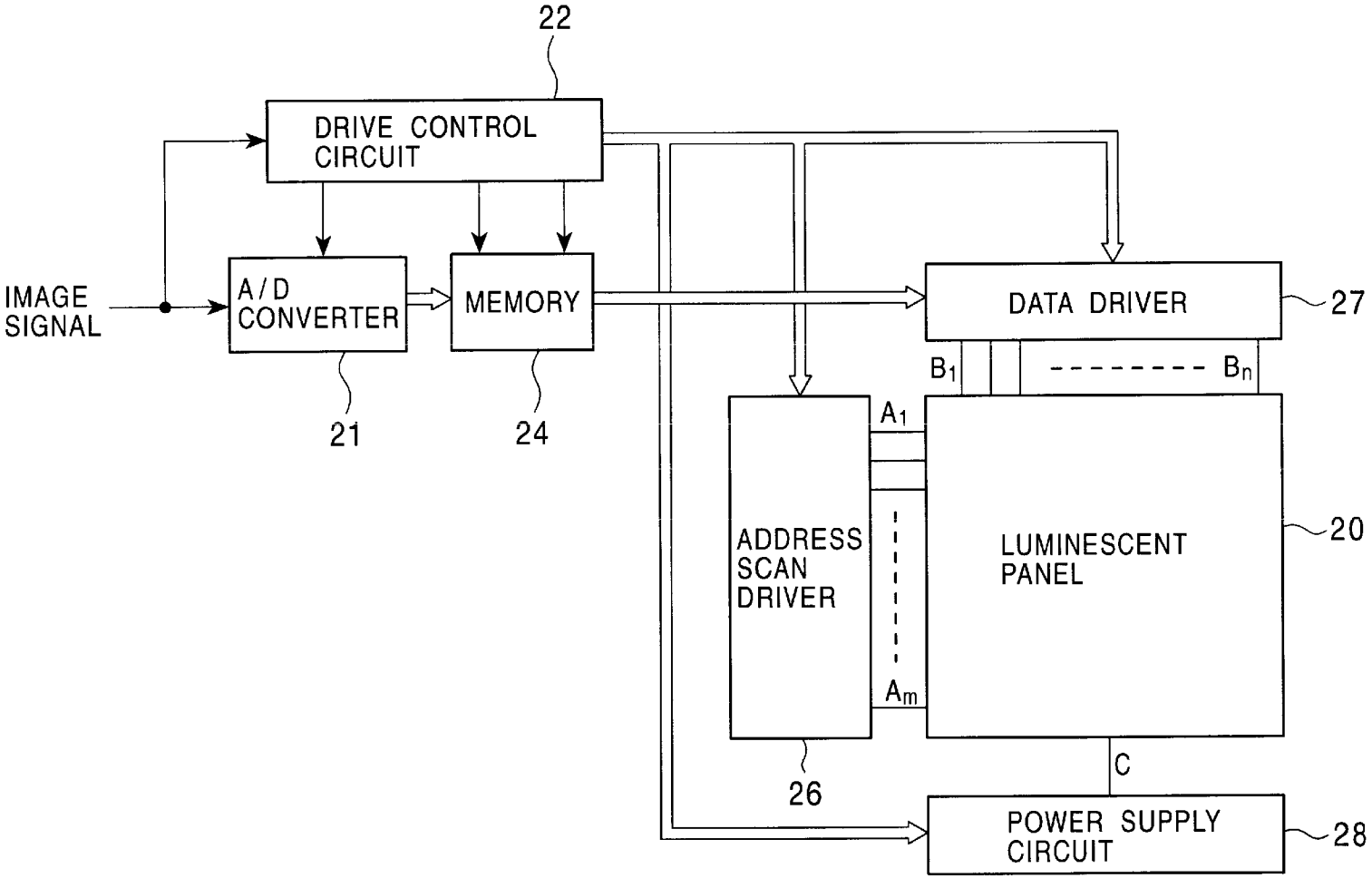
FIG. 7 is a block diagram showing a driving apparatus of simultaneous display system according to the present invention.

FIG. 7 shows a driving apparatus of simultaneous display system using EL devices according to the present invention. The driving apparatus comprises an active matrix type luminescent panel 20, an A/D converter 21, a drive control circuit 22, a memory 24, an address scan driver 26, a data driver 27, and a power supply circuit 28.

The luminescent panel 20 has a plurality of EL devices $E_{1,1}$–$E_{m,n}$ arranged in a matrix at a plurality of intersections of address lines $A_1$–$A_m$ and data lines $B_1$–$B_n$. The respective anodes of the EL devices $E_{1,1}$–$E_{m,n}$ are connected to a common power supply line C.

The address scan driver 26 is connected to the address lines $A_1$–$A_m$ of the luminescent panel 20. The address scan driver 26 supplies the individual address lines $A_1$–$A_m$ with either a potential Vcc or a 0-V ground potential. The data driver 27 is connected to the data lines $B_1$–$B_n$ of the luminescent panel 20 to supply the individual data lines $B_1$–$B_n$ with either a positive potential $V_L$ or 0 V. The power supply circuit 28 is connected to the power supply line C to supply the power supply line C with any one potential among an emission potential Ve, a reverse bias potential −Va, and the 0-V ground potential.

The A/D converter 21 samples an analog image signal input thereto in accordance with a clock signal supplied from the drive control circuit 22. The signal sampled is converted into N-bit pixel data D corresponding to respective pixels, and supplied to the memory 24.

The memory 24 sequentially stores the above-mentioned pixel data D in accordance with a write signal supplied from the drive control circuit 22. When the storage operations for one screen (m rows, n columns) of the luminescent panel 20 are finished, the memory 24 divides pixel data $D_{11}$ to $D_{mm}$ of one screen for each bit digit in accordance with a read signal supplied from the drive control circuit 22. The resultants are read by row from the first row to the m-th row, and successively supplied to the data driver 27 as drive pixel data bit groups $DB_1$ to $DB_n$.

The drive control circuit 22 generates the clock signal for the A/D converter 21 and the write and read signals for the memory 24 in accordance with horizontal synchronizing signals and vertical synchronizing signals contained in the input image signal mentioned above.

Moreover, the drive control circuit 22 divides a single field period in the above-mentioned input image signal into eight subfields. In each subfield, the drive control circuit 22 supplies each of the address scan drive 26, the data driver 27, and the power supply circuit 28 with a timing signal for directing the application of various drive pulses to the luminescent panel 20.

Figure 8:
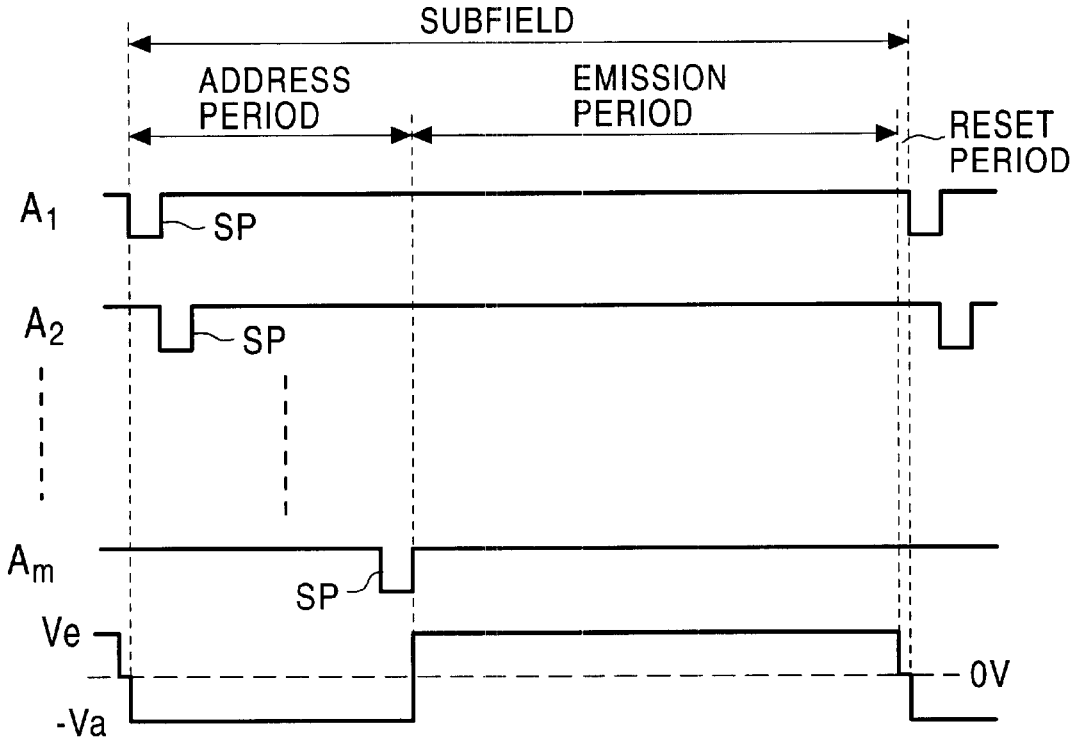
FIG. 8 is a diagram showing an address period and an emission period within a single subfield in the apparatus of FIG. 7.

Since the individual subfields involve common operations, description will be made on a single subfield alone. As shown in FIG. 8, all the address line $A_1$–$A_m$ enter an address period in a subfield. After the termination of the address period, all the address lines $A_1$–$A_m$ enter an emission period. In one field, subfields positioned temporally behind have longer emission periods.

The address scan driver 26 supplies the 0-V ground potential, as a scan pulse SP, to the address lines in order from the address line $A_1$. Supplying the scan pulse SP to the address line $A_m$ terminates the address period, followed by the emission period. Moreover, except when it supplies the scan pulses SP, the address scan driver 26 maintains the address lines $A_1$–$A_m$ at the positive potential Vcc.

The data driver 27 generates pixel data pulse groups $DP_1$–$DP_n$ corresponding to the drive pixel data bit groups $DB_1$–$DB_n$ read in succession from the memory 24, respectively. In the address period, these pixel data pulse groups $DP_1$–$DP_n$ generated are successively applied to the data lines $B_1$–$B_n$ in synchronization with the scan pulses SP. For example, the data driver 27 generates a pixel data pulse having a voltage of $V_L$ when a data bit in a drive pixel data bit group DB has a logic level of "0," generates a pixel data pulse of 0 V under a logic level of "1," and applies the same to the data lines $B_1$–$B_n$. That is, the data driver 27 applies one row (n pulses) of these pixel data pulses to the data lines $B_1$–$B_n$ as a pixel data pulse group DP mentioned above.

The power supply circuit 28, in the address period, supplies the reverse bias potential −Va to the power supply line C. In the emission period, it supplies the emission potential Ve to the power supply line C.

In the emission period, a current resulting from the emission potential Ve flows through only those EL devices on the intersections of the "rows" to which the scan pulses SP are applied in the address period and the "columns" to which the pixel data pulses of $V_L$ in voltage are applied. Thereby, the EL devices enter a luminescent state. EL devices subjected to the scan pulse SP while subjected to 0-V pixel data pulses are not applied with any current in the emission period, entering a non-luminescent state.

Figure 9:
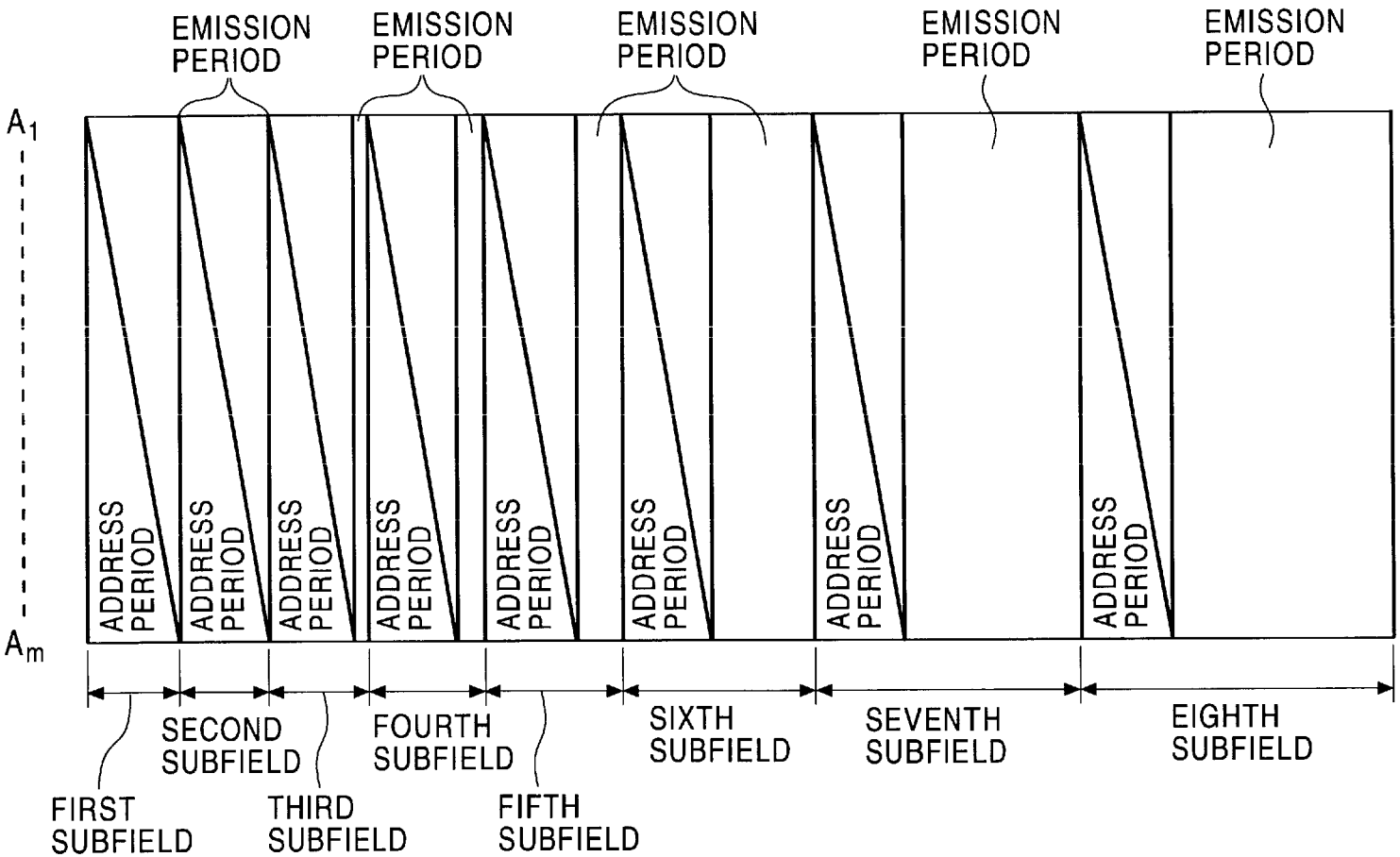
FIG. 9 is a diagram showing the subfield divisions in a single field under the simultaneous display system.

FIG. 9 shows the respective temporal positions of the first through eighth subfields in a field, with regard to the row direction of the luminescent panel 20 (the direction of the address lines $A_1$ to $A_m$). FIG. 9 also shows address periods and emission periods among the various subfields. In each subfield, the power supply circuit 28 supplies the 0-V ground potential to the power supply line C to reset the EL devices.

Figure 10:
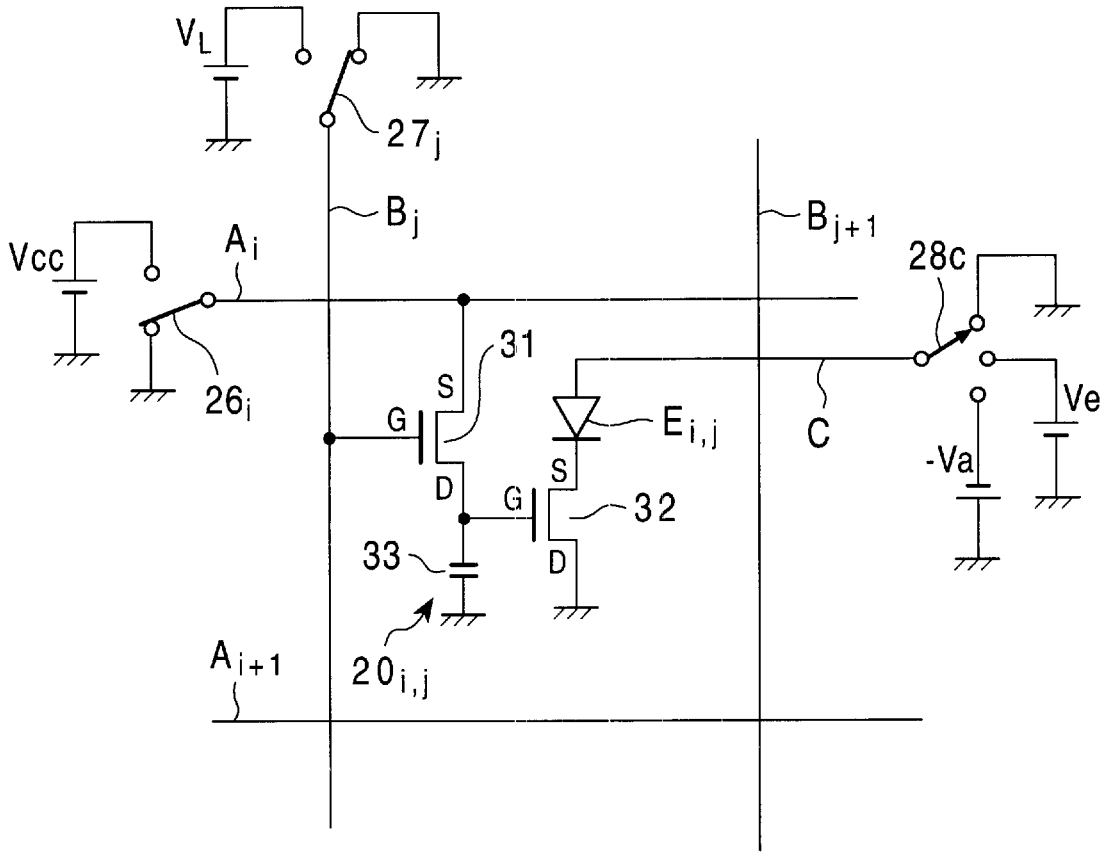
FIG. 10 is a circuit diagram showing an example of a light emitting circuit on the luminescent panel of FIG. 7.

FIG. 10 shows a light emitting circuit $\mathbf{20}_{i,j}$ including an EL device $E_{i,j}$. The EL device $E_{i,j}$ is arranged on the intersection between an address line $A_i$ of the address lines $A_1$–$A_m$ and a data line $B_j$ of the data lines $B_1$–$B_n$ in the luminescent panel 20. As well as the EL device $E_{i,j}$, the light emitting circuit $\mathbf{20}_{i,j}$ includes a P-ch MOSFET 31, an N-ch MOSFET 32, and a capacitor 33. The address line $A_i$ is connected to the source of the FET 31. The data line $B_j$ is connected to the gate of the FET 31. The drain of the FET 31 is connected to the gate of the FET 32, and the connecting line therebetween is grounded through the capacitor 33. The cathode of the EL device $E_{i,j}$ is connected to the source of the FET 32. The drain of the FET 32 is grounded. The anode of the EL device $E_{i,j}$ is connected to the power supply line C.

The address line $A_i$ is connected to a switch $\mathbf{26}_i$ in the address scan driver 26. The switch $\mathbf{26}_i$ supplies the address line $A_i$ with either the above-mentioned positive potential Vcc or 0-V ground potential. The data line $B_j$ is connected to a switch $\mathbf{27}_j$ in the data driver 27. The switch $\mathbf{27}_j$ supplies the data line $B_j$ with either the positive potential $V_L$ or the 0-V ground potential. The power supply line C is connected to a switch 28*c* in the power supply circuit 28. The switch 28*c* supplies the power supply line C with any one potential among the emission potential Ve, the reverse bias potential −Va, and the 0-V ground potential. The switches $\mathbf{26}_i$, $\mathbf{27}_j$, and 28*c* are switched in accordance with the timing signals from the drive control circuit 22.

In a subfield for the EL device $E_{i,j}$ to emit light, the switch $\mathbf{26}_i$ supplies a ground-potential scan pulse to the address line $A_i$ when the row of the address line $A_i$ enters the address period. While the scan pulse is supplied, the FET 31 is turned on and the positive potential $V_L$ is supplied to the data line $B_j$ through the switch $\mathbf{27}_j$, whereby the capacitor 33 is charged with the voltage $V_L$. Here, the terminal voltage of the capacitor 33, a positive voltage, is applied to the gate of the FET 32. Since in the address period the power supply line C is supplied with the reverse bias potential −Va from the switch 28*c*, the reverse bias potential −Va is applied to the anode of the EL device $E_{i,j}$.

When the address period terminates to enter the emission period, the switch $\mathbf{26}_i$ supplies the positive potential Vcc to the address line $A_i$, turning off the FET 31. Meanwhile, the emission voltage Ve from the switch 28*c* is supplied to the anode of the EL device $E_{i,j}$ through the power supply line C in the emission period. The FET 32 is turned on because the charge voltage of the capacitor 33 is applied to its gate. Accordingly, the emission voltage Ve is applied to the EL device $E_{i,j}$ in the forward direction, so that a current flows to bring the EL device $E_{i,j}$ into the luminescent state.

When the emission period terminates, the switch 28*c* supplies the 0-V ground potential to the power supply line C so that the EL device $E_{i,j}$ becomes approximately 0 V across to enter a reset period.

The light emitting circuit $\mathbf{20}_{i,j}$ performs the same operations in each of the first through eighth subfields. Moreover, each light emitting circuits $\mathbf{20}_{1,1}$–$\mathbf{20}_{m,n}$ (not shown) in the luminescent panel 20 other than the light emitting circuit $\mathbf{20}_{i,j}$ also performs the same operations as those of the light emitting circuit $\mathbf{20}_{i,j}$.

Figure 11:
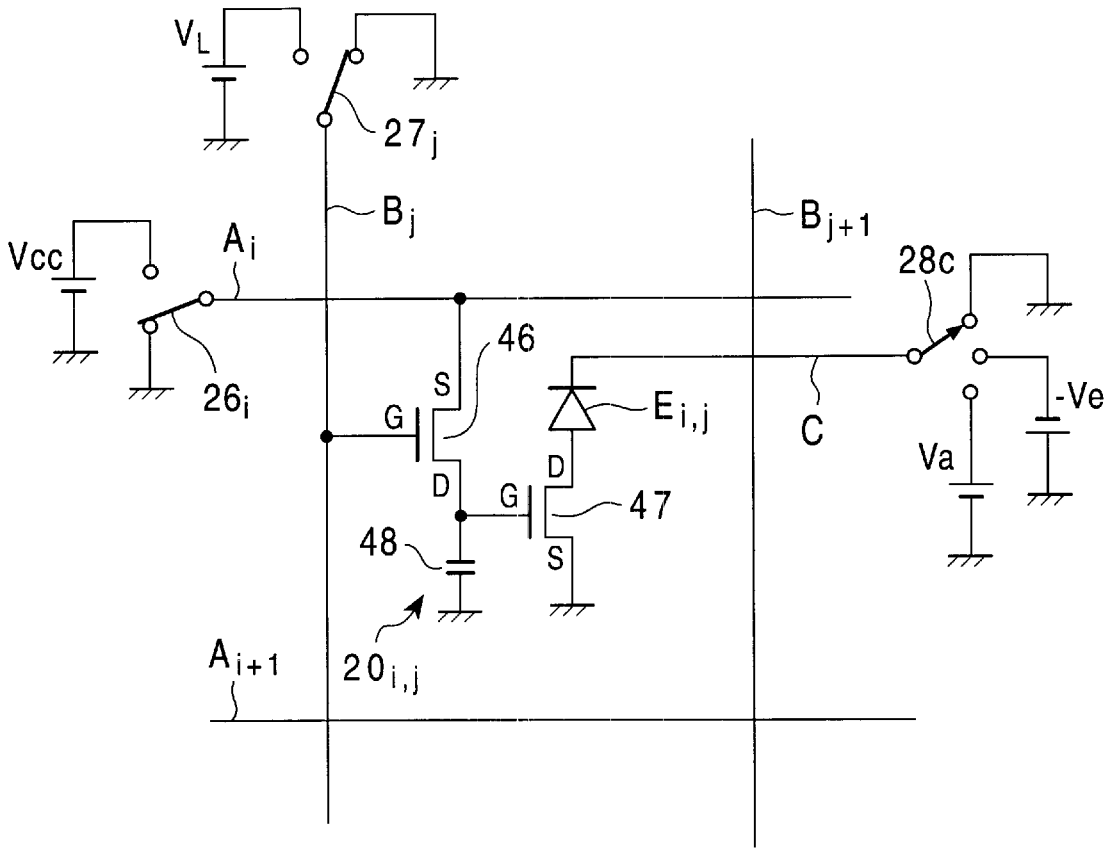
FIG. 11 is a circuit diagram showing another example of a light emitting circuit on the luminescent panel of FIG. 7.

The light emitting circuit $\mathbf{20}_{i,j}$ may be configured as shown in FIG. 11. The light emitting circuit $\mathbf{20}_{i,j}$ in FIG. 11 comprises an N-ch MOSFET 46, a P-ch MOSFET 47, and a capacitor 48, as well as the EL device $E_{i,j}$. The address line $A_i$ is connected to the source of the FET 46. The data line $B_j$ is connected to the gate of the FET 46. The drain of the FET 46 is connected to the gate of the FET 47, and the connecting line therebetween is grounded through the capacitor 48. The anode of the EL device $E_{i,j}$ is connected to the drain of the FET 47. The source of the FET 47 is grounded.

The switch $\mathbf{26}_i$ supplies the address line $A_i$ with either the positive potential Vcc or the 0-V ground potential. The switch $\mathbf{27}_j$ supplies the data line $B_j$ with either the positive potential $V_L$ or the 0-V ground potential. The switch 28*c* supplies the power supply line C with any one potential among an emission potential −Ve, a reverse bias potential Va, and the 0-V ground potential. The switches $\mathbf{26}_i$, $\mathbf{27}_j$, and 28*c* are turned in accordance with the timing signals from the drive control circuit 22.

In a subfield for the EL device $E_{i,j}$ to emit light, the switch $\mathbf{26}_i$ supplies a scan pulse having the positive potential Vcc to the address line $A_i$ when the row of the address line $A_i$ enters the address period. While the scan pulse is supplied, the FET 46 is turned on and the positive potential $V_L$ is supplied to the data line $B_j$ through the switch $\mathbf{27}_j$, so that the capacitor 48 is charged with the voltage $V_L$. Here, the terminal voltage of the capacitor 48, a positive voltage, is applied to the gate of the FET 47. Since in the address period the power supply line C is supplied with the reverse bias potential Va from the switch 28*c*, the reverse bias potential Va is applied to the cathode of the EL device $E_{i,j}$. That is, all the EL devices $E_{i,j}$ in the luminescent panel 20 are reverse-biased in the address period.

When the address period terminates to enter the emission period, the switch $\mathbf{26}_i$ supplies the 0-V ground potential to the address line $A_i$, turning off the FET 46. During the emission period, the emission voltage −Ve from the switch 28*c* is supplied to the cathode of the EL device $E_{i,j}$ through the power supply line C. The FET 47 is turned on because the charge voltage of the capacitor 48 is applied to its gate. Accordingly, the emission voltage Ve is applied to the EL device $E_{i,j}$ in the forward direction, so that a current flows to bring the EL device $E_{i,j}$ into the luminescent state.

When the emission period terminates, the switch 28*c* supplies the 0-V ground potential to the power supply line C so that the EL device $E_{i,j}$ becomes approximately 0 V across to enter a reset period.

The light emitting circuit $\mathbf{20}_{i,j}$ performs the same operations in each of the first through eighth subfields. Moreover, each light emitting circuits $\mathbf{20}_{1,1}$–$\mathbf{20}_{m,n}$ (not shown) in the luminescent panel 20 other than the light emitting circuit $\mathbf{20}_{i,j}$ also performs the same operations as those of the light emitting circuit $\mathbf{20}_{i,j}$.

In the above-described embodiments, in an address period, a reverse bias voltage is applied to those EL devices to be operated for light emission in the following emission period. However, the reverse bias voltage may also be applied to nonoperational EL devices.

The above-described embodiments have shown apparatuses that make brightness adjustments under a time modulation system (subfield system). Now, description will be given of an apparatus for performing brightness adjustments under a current modulation system.

Figure 12:
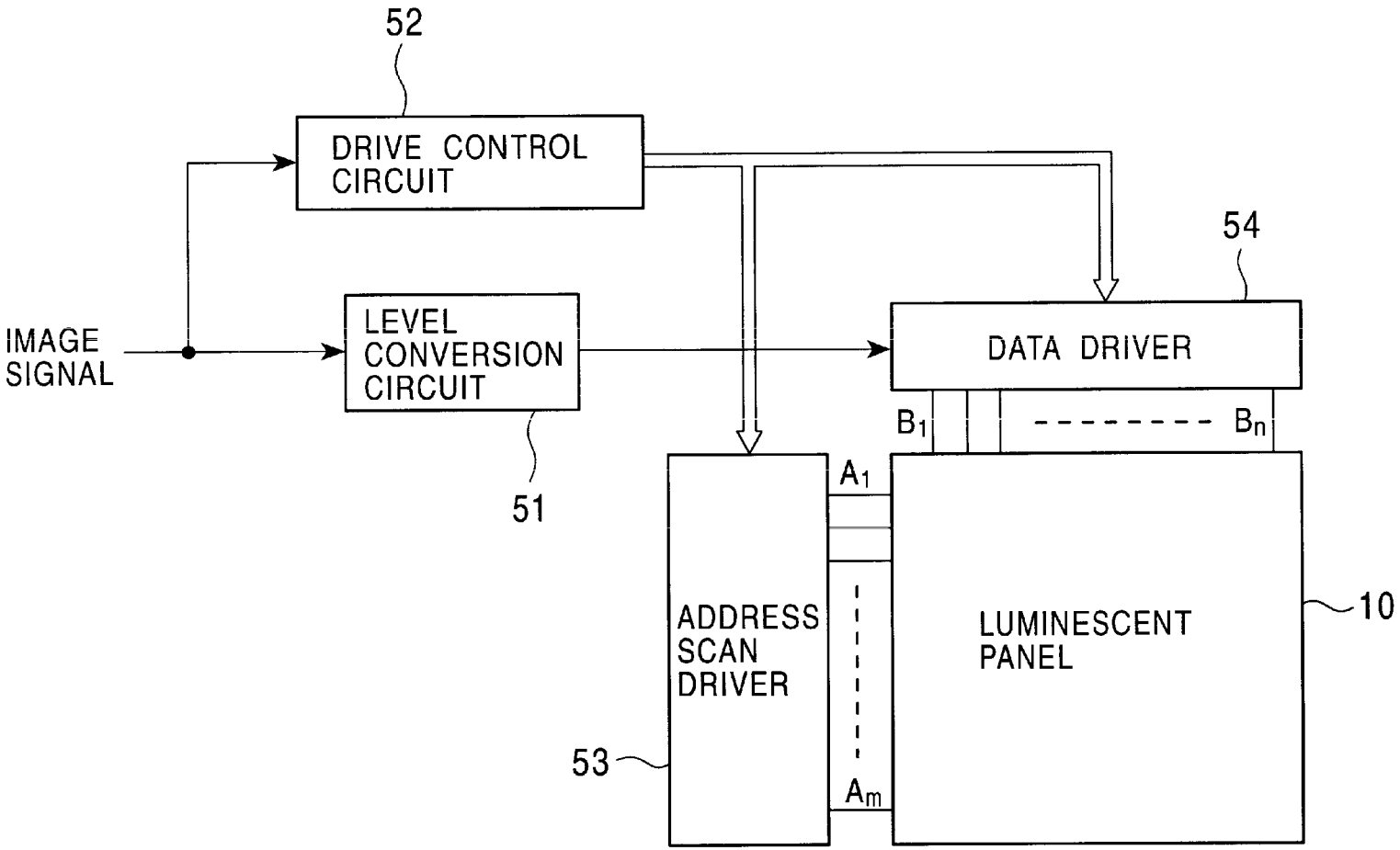
FIG. 12 is a block diagram showing a driving apparatus which makes brightness adjustments under a current modulation system.

FIG. 12 shows a driving apparatus for making brightness adjustments under a current modulation system. Like the apparatus of FIG. 2, the driving apparatus performs light emissions of a line-sequential display system. As shown in FIG. 12, the driving apparatus comprises an active matrix type luminescent panel 10, a level conversion circuit 51, a drive control circuit 52, an address scan driver 53, and a data driver 54.

Figure 13:
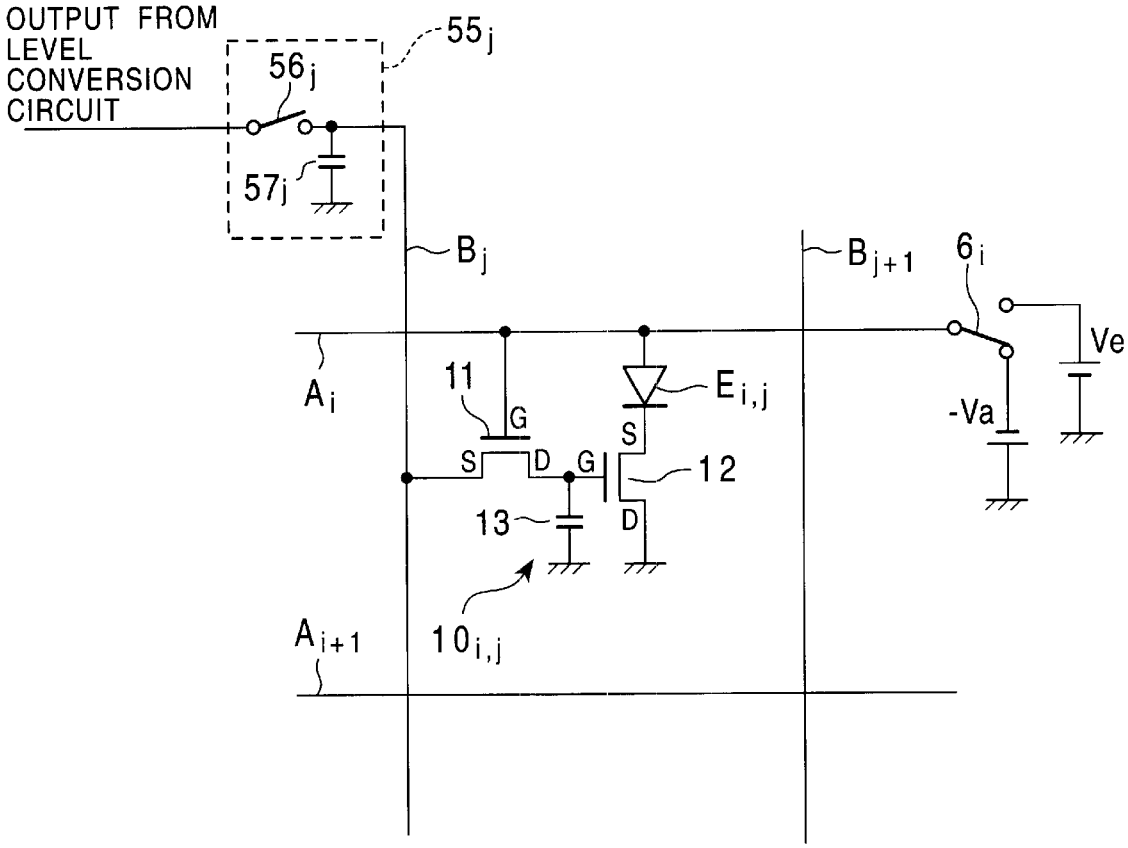
FIG. 13 is a circuit diagram showing an example of a light emitting circuit on the luminescent panel of FIG. 12.

As shown in FIG. 13, the active matrix type luminescent panel 10 has the same configuration as that shown in FIG. 2. The level conversion circuit 51 detects brightness levels in an input image signal. The level conversion circuit 51 supplies the data driver 54 with voltage signals based on the brightness levels in association with data lines $B_1$–$B_n$ in the luminescent panel 10. Here, FIG. 13 shows a light emitting circuit $\mathbf{10}_{i,j}$ including an EL device $E_{i,j}$ which is arranged on the intersection between an address line $A_i$ of address lines $A_1$–$A_m$ and a data line $B_j$ of the data lines $B_1$–$B_n$ in the luminescent panel 10.

The address scan driver 53 is connected to the address lines $A_1$–$A_m$ of the luminescent panel 10. The address scan driver 53 includes switches for supplying the individual address lines $A_1$–$A_m$ with either an emission potential Ve exceeding an emission threshold Vth, or a reverse bias potential −Va. In FIG. 13, a switch $\mathbf{6}_i$ selectively supplies the address line $A_i$ with either of the above-mentioned emission potential Ve and reverse bias potential −Va. The switch 6 is switched in accordance with a timing signal from the drive control circuit 52.

The data driver 54 has a sample holding circuit ($\mathbf{55}_j$ in FIG. 13) for each of the data lines $B_1$–$B_n$ in the luminescent panel 10. The sample holding circuits, each consisting of a switch and a capacitor, are configured so that the voltage signals corresponding to the brightness levels are supplied thereto from the level conversion circuit 51. The outputs of the sample holding circuits are connected to the corresponding data lines $B_1$–$B_n$.

In accordance with horizontal synchronizing signals and vertical synchronizing signals contained in the input image signal mentioned above, the drive control circuit 52 supplies both the address scan driver 53 and the data driver 54 with a timing signal for directing the application of various drive pulses to the luminescent panel 10 in a field period of the input image signal.

Figure 14:
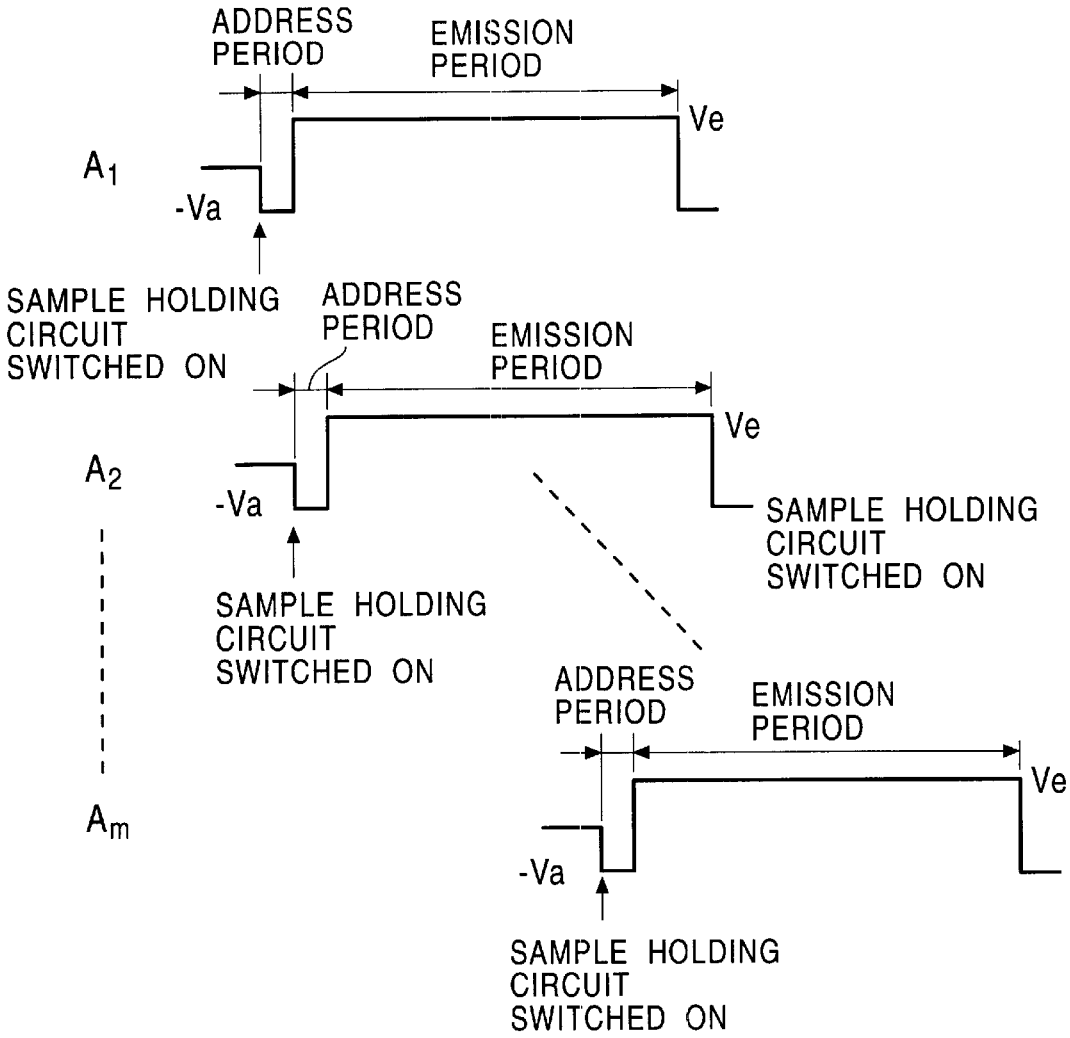
FIG. 14 is a diagram showing address periods and emission periods within a single field in the apparatus of FIG. 12.

As shown in FIG. 14, address periods in a single field period begin with the address line $A_1$. The address periods for the address lines are delayed starting each by a predetermined period toward the address line $A_m$. In an address period, the address scan driver 53 supplies the address line with the reverse bias potential −Va as a scan pulse SP. The end of an address period is followed by an emission period, in which the address scan driver 53 supplies the emission potential Ve to the address line. In one field, for every address line, the address periods have the same length and the emission periods also have the same length.

In the data driver 54, the voltage signals read in succession from the level conversion circuit 51, corresponding to the respective data lines $B_1$–$B_n$ are supplied to the sample hold circuits for retention. A switch $\mathbf{56}_j$ in the sample holding circuit $\mathbf{55}_j$ is temporarily turned on immediately before the address period, so that the capacitor $\mathbf{57}_j$ holds the voltage signal. The switch $\mathbf{56}_j$ is turned on/off in accordance with the timing signal supplied from the drive control circuit 52. The held level from the capacitor $\mathbf{57}_j$ in the sample holding circuit $\mathbf{55}_j$ is applied to the data line in an address period, forming a pixel data pulse.

Here, in an emission period, a current flows through only those EL devices on the intersections of the "row" to which the scan pulse SP is applied and the "columns" to which pixel data pulses of held levels are applied, whereby the EL devices enter a luminescent state. Meanwhile, EL device subjected to the scan pulse SP while subjected to pixel data pulses having a held level of 0 V undergo no current in the emission period, entering a non-luminescent state.

In a field where the EL device $E_{i,j}$ in the light emitting circuit $\mathbf{10}_{i,j}$ of FIG. 13 emits light, the switch $\mathbf{56}_j$ is turned on just before the row of the address line $A_i$ enters its address period. The capacitor $\mathbf{57}_j$ thus holds the voltage signal having a positive voltage corresponding to the brightness level supplied from the level conversion circuit 51. Then, the switch $\mathbf{56}_j$ is turned off immediately. When the row of the address line $A_i$ enters the address period, the switch $\mathbf{6}_i$ supplies the reverse bias potential −Va to the address line $A_i$. Here, the negative potential −Va is applied to the anode of the EL device $E_{i,j}$. Since the cathode of the EL device $E_{i,j}$ is at the ground potential, the EL device $E_{i,j}$ is reverse-biased. During the address period, the data line $B_j$ is supplied with the voltage signal held in the capacitor $\mathbf{57}_j$, whereby the FET 11 is turned on to charge the capacitor 13 with the voltage signal. Here, the terminal voltage of the capacitor 13, a positive voltage, is applied to the gate of the FET 12.

When the address period terminates to enter an emission period, the switch $6_i$ supplies the emission voltage Ve to the address line $A_i$, turning off the FET 11. Meanwhile, the FET 12 is turned on or activated because the charge voltage of the capacitor 13 is applied to its gate. The FET 12 is turned on or active in accordance with the voltage applied to its gate, i.e., the brightness level.

When the FET 12 is on, the cathode of the EL device $E_{i,j}$ is equalized to the ground potential. Since the emission voltage Ve is applied to the EL device $E_{i,j}$ in the forward direction, a current flows to bring the EL device $E_{i,j}$ into the luminescent state. When the FET 12 is active, a current corresponding to the charge voltage in the capacitor 13 flows through the EL device $E_{i,j}$ and between the source and drain of the FET 12. The result is that the EL device $E_{i,j}$ emits light with a brightness corresponding to the brightness level in the image signal.

Figure 15:
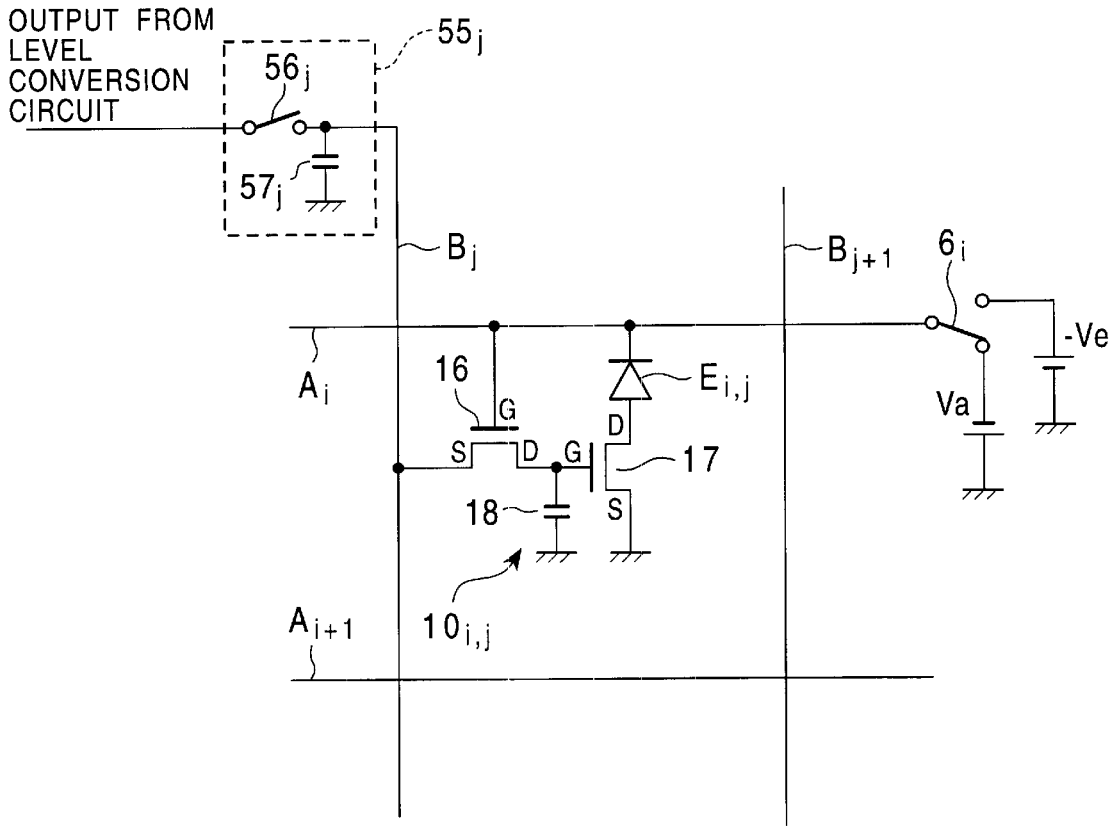
FIG. 15 is a circuit diagram showing another example of a light emitting circuit on the luminescent panel of FIG. 12.

The light emitting circuit $10_{i,j}$ in the current-modulation system driving apparatus may be configured as shown in FIG. 15. The light emitting circuit $10_{i,j}$, as shown in FIG. 15, comprises an N-ch MOSFET 16, a P-ch MOSFET 17 and a capacitor 18, as well as the EL device $E_{i,j}$.

The switch $6_i$ connected to the address line $A_i$ selectively supplies the address line $A_i$ with either of the above-mentioned emission potential −Ve and reverse bias potential Va.

In a field for this EL device $E_{i,j}$ in FIG. 15 to emit light, the switch $56_j$ is turned on just before the row of the address line $A_i$ enters its address period, so that the voltage signal having a positive potential, supplied from the level conversion circuit 51 is held in the capacitor $57_j$. Then, the switch $56_j$ is turned off immediately. When the row of the address line $A_i$ enters the address period, the switch $6_i$ supplies the reverse bias potential Va to the address line $A_i$. Here, the positive potential Va is applied to the cathode of the EL device $E_{i,j}$. Since its cathode is at the ground potential, the EL device $E_{i,j}$ is reverse-biased. During the address period, the data line $B_j$ is supplied with the voltage signal having the positive voltage, whereby the FET 16 is turned on to charge the capacitor 18 with the voltage signal. Here, the terminal voltage of the capacitor 18, the positive voltage, is applied to the gate of the FET 17.

When the address period terminates to enter an emission period, the switch $6_i$ supplies the emission voltage −Ve to the address line $A_i$, turning off the FET 16. Meanwhile, the FET 17 is turned on or active because the charge voltage of the capacitor 18 is applied to its gate. The FET 17 is turned on or active in accordance with the voltage applied to its gate from the capacitor 18, i.e., the brightness level.

When the FET 17 is on, the anode of the EL device $E_{i,j}$ is equalized to the ground potential. Since the emission voltage Ve is applied to the EL device $E_{i,j}$ in the forward direction, a current flows to bring the EL device $E_{i,j}$ into the luminescent state. When the FET 17 is active, a current corresponding to the charge voltage in the capacitor 13 flows through the EL device $E_{i,j}$ and between the source and drain of the FET 17. The result is that the EL device $E_{i,j}$ emits light with a brightness corresponding to the brightness level in the image signal.

As has been described above, according to the present invention, it is possible to apply a reverse bias voltage to each EL device in an active matrix type luminescent panel during an address period or address periods. Consequently, the EL devices can be extended in life.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A driving apparatus for an active matrix type luminescent panel including a plurality of capacitive light emitting devices arranged in a matrix, each having polarity, and driving devices for driving said plurality of capacitive light emitting devices individually, the driving apparatus comprising:

setting means for setting an address period and an emission period repeatedly on each of said plurality of capacitive light emitting devices in accordance with synchronizing timing in input image data;

ON holding means for designating a driving device of said driving devices corresponding to at least a device to be light-emitted of said plurality of capacitive light emitting devices in accordance with said input image data in said address period so that said designated driving device is turned on in said emission period subsequent to said address period; and voltage applying means for applying an emission voltage, in forward polarity, to said device to be light-emitted through said designated driving device in said emission period, wherein said voltage applying means applies a bias voltage, in polarity reverse to said forward polarity, to at least said device to be light-emitted, in said address period.

2. The driving apparatus according to claim 1, wherein said voltage applying means applies said bias voltage to said device to be light-emitted through the corresponding driving device.

3. The driving apparatus according to claim 1, wherein said setting means sets said address period and said emission period on each of said plurality of capacitive light emitting devices for each row in said luminescent panel.

4. The driving apparatus according to claim 1, wherein:

in said luminescent panel, each of said plurality of capacitive light emitting devices is connected at its anodes to an address line;

each of said driving devices includes an N-channel FET connected at its source to the cathode of a corresponding capacitive light emitting device of said plurality of capacitive light emitting devices and grounded at its drains;

said ON holding means includes, for each of said plurality of capacitive light emitting devices, a P-channel FET connected at its gate to said address line, at its source to a data line, and at its drain to the gate of said N-channel FET, and a capacitor connected between the gate of said N-channel FET and a ground;

said voltage applying means includes a first switch for applying said bias voltage to between said address line and the ground with negative potential thereof on the address-line side in said address period, and applying said emission voltage to between said address line and the ground with positive potential thereof on the address-line side in said emission period, for each address line, and a second switch for applying a predetermined voltage to between said data line and the ground with positive potential thereof on the data-line side in said address period in the case of operating said light emitting device to emit light, and applying a zero voltage to between said data line and the ground in said emission period, for each data line; and the application of said predetermined voltage makes a charge current flow through said capacitor via said P-channel FET in said address period so that the terminal voltage of said capacitor, in said subsequent emission period, turns said N-channel FET on to apply said emission voltage to said device to be light-emitted.

5. The driving apparatus according to claim 1, wherein:

in said luminescent panel, each of said plurality of capacitive light emitting devices is connected at its cathode to an address line;

each of said driving devices includes a P-channel FET connected at it drain to the anode of a corresponding capacitive light emitting device of said plurality of capacitive light emitting devices and grounded at its source;

said ON holding means includes, for each of said plurality of capacitive light emitting devices, an N-channel FET connected at its gate to said address line, at its source to a data line, and at it drain to the gate of said P-channel FET, and a capacitor connected between the gate of said P-channel FET and a ground;

said voltage applying means includes a first switch for applying said bias voltage to between said address line and the ground with positive potential thereof on the address-line side in said address period, and applying said emission voltage to between said address line and the ground with negative potential thereof on the address-line side in said emission period, for each address line, and a second switch for applying a predetermined voltage to between said data line and the ground with positive potential thereof on the data-line side in said address period in the case of operating said light emitting devices to emit light, and applying a zero voltage to between said data line and the ground in said emission period, for each data line; and the application of said predetermined voltage makes a charge current flow through said capacitor via said N-channel FET in said address period so that the terminal voltage of said capacitor, in said subsequent emission period, turns said P-channel FET on to apply said emission voltage to said device to be light-emitted.

6. The driving apparatus according to claim 1, wherein said setting means sets said address period and said emission period common on each of said plurality of capacitive light emitting devices, said address period and said emission period being at common time for every row in said luminescent panel.

7. The driving apparatus according to claim 1, wherein:

each of said driving devices includes an N-channel FET connected at its source to the cathode of a corresponding capacitive light emitting device of said plurality of capacitive light emitting devices and grounded at its drain;

said ON holding means includes, for each of said plurality of capacitive light emitting devices, a P-channel FET connected at its gate to said address line, at its source to a data line, and at its drain to the gate of said N-channel FET, and capacitor connected between the gate of said N-channel FET and a ground;

said voltage applying means includes a first switch for applying a zero voltage to between said address line and the ground in said address period, and applying a first predetermined voltage to between said address line and the ground with positive potential thereof on the address-line side in said emission period, for each address line, a second switch for applying a second predetermined voltage to between said data line and the ground with positive potential thereof on the data-line side in said address period in the case of operating said light emitting devices to emit light, and applying a zero voltage to between said data line and the ground in said emission period, for each data line and a third switch for applying said bias voltage to between the anodes of said plurality of capacitive light emitting devices and the ground with negative potential thereof on the anode sides in said address period, and applying said emission voltage to between said anodes of said plurality of capacitive light emitting devices and the ground with positive potential thereof on the anode sides in said emission period; and the application of said second predetermined voltage makes a charge current flow through said capacitor via said P-channel FET in said address period so that the terminal voltage of said capacitor, in said subsequent emission period, turns said N-channel FET on to apply said emission voltage to said device to be light-emitted.

8. The driving apparatus according to claim 1, wherein:

each of said driving devices includes a P-channel FET connected at its drain to the anode of a corresponding capacitive light emitting device of said plurality of capacitive light emitting devices and grounded at its source;

said ON holding means includes, for each of said plurality of capacitive light emitting devices, an N-channel FET connected at its gate to said address line, at its source to a data line, and at its drain to the gate of said P-channel FET, and a capacitor connected between the gate of said P-channel FET and a ground;

said voltage applying means includes a first switch for applying a first predetermined voltage to between said address line and the ground with positive potential thereof on the address-line side in said address period, and applying a zero voltage to between said address line and the ground in said emission period, for each address line, a second switch for applying a second predetermined voltage to between said data line and the ground with positive potential thereof on the data-line side in said address period in the case of operating said light emitting devices to emit light, and applying a zero voltage to between said data line and the ground in said emission period, for each data line, and a third switch for applying said bias voltage to between the cathodes of said plurality of capacitive light emitting devices and the ground with positive potential thereof on the cathode sides in said address period, and applying said emission voltage to between the cathodes of said plurality of capacitive light emitting devices and the ground with negative potential thereof on the cathode sides in said emission period; and the application of said second predetermined voltage makes a charge current flow through said capacitor via said N-channel FET in said address period so that the terminal voltage of said capacitor, in said subsequent emission period, turns said P-channel FET on to apply said emission voltage to said device to be light-emitted.

9. A driving apparatus for an active matrix type luminescent panel including a plurality of capacitive light emitting devices arranged in a matrix, each having polarity, and active devices for driving said plurality of capacitive light emitting devices individually, the driving apparatus comprising:

setting means for setting an address period and an emission period repeatedly on each of said plurality of capacitive light emitting devices in accordance with synchronizing timing in input image data;

designating means for accepting and holding a brightness voltage corresponding to a brightness level in said input image data immediately before said address period, and designating, in said address period, an active device corresponding to at least a device to be light-emitted of said plurality of capacitive light emitting devices in accordance with said brightness voltage;

holding means for turning the designated active device on or active in accordance with said brightness voltage in said emission period subsequent to said address period; and voltage applying means for applying an emission voltage, in forward polarity, to said device to be light-emitted through said designated active device in said emission period, wherein said voltage applying means applies a bias voltage, in polarity reverse to said forward polarity, to at least said device to be light-emitted of said plurality of capacitive light emitting devices in said address period.

10. The driving apparatus according to claim 9, wherein said setting means sets said address period and said emission period for each of said plurality of capacitive light emitting devices by row in said luminescent panel.

11. The driving apparatus according to claim 9, wherein:

in said luminescent panel, each of said plurality of capacitive light emitting devices is connected at its anodes to an address line;

each of said active devices includes an N-channel FET connected at its source to the cathode of a corresponding capacitive light emitting device of said plurality of capacitive light emitting devices and grounded at its drain;

said designating means includes, for each data line, a sample holding circuit for receiving a brightness voltage corresponding to a brightness level in said input image data immediately before said address period and applying a held voltage to a data line in said address period;

said holding means includes, for each of said plurality of capacitive light emitting devices, a P-channel FET connected at its gate to said address line, at its source to said data line, and at its drain to the gate of said N-channel FET, and a capacitor connected between the gate of said N-channel FET and a ground;

said voltage applying means includes, for each address line, a switch for applying said bias voltage to between said address line and the ground with negative potential thereof on the address-line side in said address period, and applying said emission voltage to between said address line and the ground with positive potential thereof on the address-line side in said emission period; and the application of said held voltage by said sample hold circuits makes a charge current flow through said capacitor via said P-channel FET in said address period so that the terminal voltage of said capacitor, in said subsequent emission period, turns said N-channel FET on or active to apply said emission voltage to said device to be light-emitted through said N-channel FET.

12. The driving apparatus according to claim 9, wherein:

in said luminescent panel, each of said plurality of capacitive light emitting devices is connected at its cathode to an address line;

each of said active devices includes a P-channel FET connected at its drain to the anodes of a corresponding capacitive light emitting device of said plurality of capacitive light emitting devices and grounded at its drain;

said designating means includes, for each data line, a sample holding circuit for receiving a brightness voltage corresponding to a brightness level in said input image data immediately before said address period and applying a held voltage to a data line in said address period;

said holding means includes, for each of said plurality of capacitive light emitting devices, an N-channel FET connected at its gate to said address line, at its source to said data line, and at its drain to the gate of said P-channel FET, and a capacitor connected between the gate of said P-channel FET and a ground;

said voltage applying means includes, for each address line, a switch for applying said bias voltage to between said address line and the ground with positive potential thereof on the address-line side in said address period, and applying said emission voltage to between said address line and the ground with negative potential thereof on the address-line side in said emission period; and the application of said held voltage by said sample hold circuit makes a charge current flow through said capacitor via said N-channel FET in said address period so that the terminal voltage of said capacitor, in said subsequent emission period, turns said P-channel FET on or active to apply said emission voltage to said device to be light-emitted through said P-channel FET.

* * * * *